US005153093A

United States Patent [19]

Sacripante et al.

[11] Patent Number: 5,153,093

[45] Date of Patent: Oct. 6, 1992

[54] OVERCOATED ENCAPSULATED TONER COMPOSITIONS AND PROCESSES THEREOF

[75] Inventors: Guerino G. Sacripante, Cambridge; Beng S. Ong; Lurdes M. Martins, both of Mississauga, all of Canada

[73] Assignee: Xerox Corporation, Stamford, Conn.

[21] Appl. No.: 670,655

[22] Filed: Mar. 18, 1991

[51] Int. Cl.[5] ..... G03G 9/08

[52] U.S. Cl. ..... 430/138; 430/137; 430/110

[58] Field of Search ..... 430/109, 137, 138, 110

[56] References Cited

U.S. PATENT DOCUMENTS

| | | | |
|---|---|---|---|
| 4,307,169 | 12/1981 | Matkan | 430/111 |
| 4,524,199 | 6/1985 | Lok et al. | 527/313 |
| 4,565,764 | 1/1986 | Nakahara et al. | 430/111 |
| 4,576,890 | 3/1986 | Hosoi | 430/137 |
| 4,626,489 | 12/1986 | Hyosu | 430/137 |
| 4,727,011 | 2/1988 | Mahabadi et al. | 430/138 |
| 4,869,990 | 9/1989 | Hosoi | 430/137 |
| 5,035,970 | 7/1991 | Hsieh et al. | 430/109 |

*Primary Examiner*—John Goodrow
*Attorney, Agent, or Firm*—E. O. Palazzo

[57] ABSTRACT

An encapsulated toner composition comprised of a core comprised of polymer resins, color pigments, dyes, or mixtures thereof, encapsulated within an optional condensation polymer shell, and a polymeric surfactant shell and overcoated thereon a polymeric overcoating.

45 Claims, No Drawings

OVERCOATED ENCAPSULATED TONER COMPOSITIONS AND PROCESSES THEREOF

BACKGROUND OF THE INVENTION

The present invention is generally directed to toner compositions, and more specifically to encapsulated toner compositions and processes thereof. In one embodiment, the present invention is related to color encapsulated toner compositions comprised of core components such as, for example, polymer resins and colorants; thereover a polymeric shell or shells overcoated with an outer polymer layer. Another embodiment of the present invention relates to processes of preparing encapsulated toners comprised of a core containing a polymer resin, or plurality of polymer resins and colorants, such as black, red, green, blue, cyan, yellow, magenta pigments or dyes, and mixtures thereof, encapsulated within a shell comprised of certain polymeric surfactants, such as a cellulose surfactant, and an optional shell comprised of condensation polymer such as polyurea, polyurethane, polyester, polyamide, mixtures thereof, or the like, formed by interfacial polymerization, and overcoated thereon a polymeric overcoating formed by free radical polymerization.

One of the primary functions of the polymeric surfactant shell and the condensation polymer shell is to provide mechanical strength to the toner, while that of the overcoating layer is to reinforce the shell in achieving effective containment of core components, particularly the colorants. Effective containment of core components would enable complete, or substantially complete nullification or passivation of the charging effects of colorants when the toner particles are admixed with selected carriers in, for example, two component development systems. The triboelectric properties of toners are thereby controlled or substantially dominated by the charging effects of the outer overcoating material. Accordingly for two component development, similar or substantially similar equilibrium triboelectric characteristics can be achieved with the toners of the present invention regardless of the nature of the colorants present in the toners when the same carriers are utilized. For single component development where triboelectric charging is generally accomplished by a frictional charging blade, similar equilibrium triboelectric charge levels can also be obtained under identical conditions with different colored toners of the present invention. Effective containment of core components enabled by the outer overcoating layer also inhibits the leaching of core components, thereby eliminating or substantially reducing the problem of toner blocking or agglomeration in toners wherein core resins of low glass transition temperatures are utilized. Another advantage of addition polymer overcoating relates to its ability to reduce or minimize the moisture sensitivity of the toner particles. In addition, since both the shell and the overcoating layer of the toner compositions of the present invention are relatively thin in nature, their presence would not adversely affect or would minimize the toner's fusing characteristics.

In known color reprography, such as in full color or highlight color processes, colored toners with a wide variety of colors including black are usually employed. For two component development, it is highly desirable that the triboelectric properties of different colored toners can be desirably controlled, thereby permitting them to attain similar equilibrium triboelectric charging levels when utilized against the same carriers. This is especially useful for custom colored toner packages as custom colored toners can now be generated by simple physical blending of the primary colored toners. Another important issue for two component development is the rate of charging of fresh, substantially uncharged toners to the equilibrium charge levels when they are added to the toner depleted development housing. A fast rate of charging of fresh toners is important in ensuring proper image development, particularly for high speed reprographic systems.

Color pigments or dyes have a dominant effect on the triboelectric charging behavior of toners as these colorants are often present at or close to the surface of the toner, and are therefore exposed to the environment. As a consequence, when the toner particles are admixed with carriers, the interactions of the exposed pigments of the toners with the carrier particles can essentially dominate the charging behavior of the toner. This also occurs for a number of prior art encapsulated toners where the color pigment particles are not completely encapsulated within the toner shell. Toners with identical components and different colorants often exhibit different charging behavior, sometimes even to the extent of achieving triboelectric charges of opposite polarity. To overcome this difficulty, it is usually necessary to utilize different charge control additives for different colorants or to exchange the toner with charge control additives so as to nullify or overcome the different charging effects of different colorants, and to exert a dominating influence on the charging characteristics of the toners. The toners of the present invention eliminate or substantially overcome this difficulty by completely encapsulating the colorants within the toner with an outer overcoating layer. As a consequence, the need to rely on different or high levels of charge control additives for different colored toners for achieving similar triboelectric charging levels is eliminated or substantially avoided. Other advantages associated with the encapsulated toner compositions, and economical processes of the present invention include, for example, rapid triboelectric charging rates, smaller toner size and narrow size distribution for high resolution images, excellent toner color mixing properties and image color fidelity, high image projection efficiency enabling their use on transparent substrates, lower fusing temperatures, acceptable powder flow, and nonblocking and nonagglomerating characteristics. The toner compositions of the present invention can be selected for a variety of known imaging processes including electrophotographic and ionographic processes. More specifically, the toner compositions of the present invention can be selected for electrophotographic processes, especially color processes, wherein image fixing is accomplished by heat fusion.

The toner compositions of the present invention can in one specific embodiment be generated by a direct preparative process involving a physical microencapsulation via adsorption and precipitation of polymeric surfactant, such as a cellulose surfactant, an optional shell-forming interfacial polycondensation, a core resin-forming free radical polymerization, and an overcoating free radical polymerization. In an embodiment, the combined thickness of the dispersant layer and the shell is less than about 0.5 micron, and preferably less than 0.1 micron, while the thickness of the overcoating is less than about 2 microns, and preferably less than about 0.5 micron. A thin shell and a thin overcoating could ensure that the fused image would not significantly scatter incident lights even when the refractive indices of the shell and overcoating materials do not properly match with those of the core components, which light scattering may dramatically reduce the image's projection efficiency. It is also believed that a thin shell and thin overcoating, particularly those with a thickness of substantially less than 0.5 micron but greater than zero microns, would not significantly interfere with the fusing properties of the core components, which constitute the bulk of the toner composition. One embodiment of the present invention is, therefore, directed to a simple and economical preparative process for colored encapsulated toner compositions comprised of a core comprised of a polymer resin or resins and colorants, encapsulated within a thin cellulose layer and an optional thin condensation polymer shell, and overcoated thereon a thin addition polymer overcoating. The preparative process involves an initial formation of stabilized microdroplet suspension, an optional interfacial polycondensation for the formation of condensation polymer shell, a physical microencapsulation via adsorption and precipitation of cellulose surfactant for the formation of cellulose shell, a core resin formation via free radical polymerization of addition monomers, and finally an overcoating step via free radical polymerization. The process in embodiments permits the generation of small toner size particles of less than about 10 microns in volume average particle diameter, and generally in the range of from about 2 to about 8 microns, with a narrow size distribution of less than 1.4, and in many instances, equal to or less than 1.3, without effecting the energy intensive known pulverization and particle size classification techniques. Furthermore, the process of the present invention also enables the generation of colored toner particles with controlled triboelectric properties when these particles are utilized in conjunction with selected carrier particles for two component development. The controlled charging characteristics of toner particles also render their use in single component development highly desirable since the same or substantially similar triboelectric charging levels can be readily accomplished using a frictional charging mechanism regardless of the colorants present in the toners. The aforementioned toners prepared in accordance with the process of the present invention are useful for permitting the development of images in reprographic imaging systems, inclusive of electrophotographic and ionographic imaging processes wherein the image is fused by heat, photochemical energy, pressure, or a combination of these fusing techniques.

Encapsulated toners and processes are known. For example, both U.S. Pat. No. 4,626,489 and British Patent 1,538,787 disclose similar processes for colored encapsulated toners wherein both the core resin and shell materials are prepared by suspension polymerization techniques. U.S. Pat. No. 4,565,764 discloses a colored microcapsule toner comprised of a colored core encapsulated by two resin shells with the inner shell having an affinity for both the core and the outer shell materials; U.S. Pat. No. 4,254,201 illustrates the use of pressure sensitive toner clusters or aggregates with each granule of the cluster or aggregate being comprised of a pressure sensitive adhesive substance encapsulated by coating film. Color pigment particles or magnetic particles can be present on the surfaces of the encapsulated granules to impart the desired color to the toners. Also, U.S. Pat. No. 4,727,011 discloses a process for preparing encapsulated toners which involves a shell forming interfacial polycondensation and a core binder forming free radical polymerization, and further U.S. Pat. No. 4,708,924 discloses the use of a mixture of two polymers, one having a glass transition temperature in the range of −90° C. to 5° C., and the other having a softening temperature in the range of 25° C. to 180° C., as the core binders for a pressure fixable encapsulated toner. Other prior art, all U.S. patents, are summarized below: U.S. Pat. No. 4,339,518, which relates to a process of electrostatic printing with fluorinated polymer toner additives where suitable materials for the dielectric toner are thermoplastic silicone resins and fluorine containing resins having low surface energy, reference column 4, beginning at line 10, note for example the disclosure in column 4, line 16, through column 6; U.S. Pat. No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18; U.S. Pat. No. 4,265,994 directed to pressure fixable capsule toners with polyolefins, such as polytetrafluoroethylene, see for example column 3, beginning at line 15; U.S. Pat. No. 4,497,885, which discloses a pressure fixable microcapsule toner comprising a pressure fixable component, a magnetic material, and other optional components, and wherein the core material can contain a soft material typical examples of which include polyvinylidenefluoride, polybutadiene, and the like, see column 3, beginning at line 10; U.S. Pat. No. 4,520,091 discloses an encapsulated toner with a core which comprises a colorant, a dissolving solvent, a nondissolving liquid and a polymer, and may include additives such as fluorine containing resin, see column 10, beginning at line 27; U.S. Pat. No. 4,590,142 relating to capsule toners wherein additives such as polytetrafluoroethylenes are selected as lubricating components, see column 5, beginning at line 52; U.S. Pat. Nos. 4,599,289 and 4,803,144.

With further specific reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

In a patentability search report, there were recited the following U.S. patents: U.S. Pat. No. 4,576,890 which discloses a process for the preparation of encapsulated toners comprising a stage of forming shells around microdroplets of a core material containing colorant dispersed in an aqueous medium to produce microcapsules therein and the stage of separating the microcapsules from the aqueous solution and wherein methylcellulose is employed for stabilizing the microdroplets of the core material in the aqueous solution, reference the Abstract of the Disclosure for example; U.S. Pat. No. 4,565,764 which discloses a microcapsule toner having a colored core material coated successively with a specific first resin wall and a second resin wall, reference the Abstract of the Disclosure, and note the disclosure in column 5 wherein the first resin wall is indicated as being obtained by reacting an olefinic carboxylic acid chloride with a core material in the presence of an acid eliminating agent, see column 5, beginning at line 30, and continuing on to column 6; also note column 7 wherein examples of the second wall are provided, and wherein examples include with respect to the first wall polyvinylalcohol, resins known in the art such as homopolymers or copolymers of monomers such as styrene or its derivatives; and as of collateral interest U.S. Pat. No. 4,524,199.

The disclosures of all the U.S. patents and other patent documents mentioned herein are totally incorporated herein by reference.

Illustrated in U.S. Pat. No. 4,758,506, the disclosure of which is totally incorporated herein by reference, are single component pressure fixable toner compositions, wherein the shell selected can be prepared by an interfacial polymerization process. A similar teaching is present in application U.S. Ser. No. 718,676 (now abandoned), the disclosure of which is totally incorporated herein by reference. In the aforementioned application, the core can be comprised of magnetite and a polyisobutylene of a specific molecular weight encapsulated in a polymeric shell material generated by an interfacial polymerization process. A number of other copending applications illustrate various encapsulated toner compositions including, for example, U.S. Pat. No. 5,043,240, U.S. Pat. No. 5,035,970, U.S. Pat. No. 5,037,716, U.S. Ser. No. 516,864, U.S. Pat. No. 5,045,428, U.S. Pat. No. 5,077,167, U.S. Ser. No. 456,278, U.S. Pat. No. 5,114,819, U.S. Pat. No. 5,082,757, U.S. Ser. No. 617,222, U.S. Pat. No. 5,023,159 and U.S. Pat. No. 5,013,630, the disclosures of each of the aforementioned copending applications being totally incorporated herein by reference.

A number of the prior art encapsulated toner compositions, in particular colored toner compositions, suffer from a number of deficiencies as indicated herein. For example, these toner compositions may not have the desirable fusing properties such as being able to be fused at reasonably low temperature of, for example, less than 170° C.; they generally possess very low image projection efficiency either because of a significant difference in the refractive indices of the shell and core components or because of a poor colorant dispersion within the core; they usually require different or excessive amounts of charge control agents for different colored toners; and their rates of triboelectric charging are poor. In addition, some prior art colored encapsulated toners cannot be obtained in smaller toner size of, for example, less than 7 or 8 microns with a narrow size distribution of, for example, less than about 1.35 in a cost effective manner. Also, toner blocking or agglomeration may be a problem with several of the prior art encapsulated toners because of the porosity of the shell structure, especially when they are exposed to conditions of elevated temperatures. Further, some of the prior art colored encapsulated toners are comprised of colored pigment particles that may not completely be encapsulated by the shell, and the triboelectric charging effects of such pigments are therefore not fully passivated, and this would adversely affect and degrade the toner triboelectric characteristics, thereby causing image quality to deteriorate. These and other disadvantages are eliminated or substantially eliminated with the process and toner compositions of the present invention. More specifically, thus with the encapsulated toners of the present invention, the toner properties can in many instances be tailored to certain specifications. Specifically, with the toners of the present invention in embodiments complete or substantial passivation of the triboelectric charging effects of the colorants is accomplished, and smaller toner particle size with narrow size distribution can be achieved with the process of the present invention without conventional classification techniques. In addition, excellent image projection efficiency can be obtained with the toners of the present invention in embodiments since both the shell and the overcoating layer are relatively thin in nature. Also, the toners of the present invention do not block or agglomerate over a long period of time in embodiments.

SUMMARY OF THE INVENTION

It is a feature of the present invention to provide encapsulated toner compositions with many of the advantages illustrated herein.

In another feature of the present invention there are provided encapsulated toner compositions comprised of a core encapsulated in a thin polymer shell overcoated with a thin triboelectric charge dominating layer.

In another feature of the present invention there are provided encapsulated toner compositions comprised of a core comprised of an addition polymer resin and colorants, a thin cellulose shell, an optional condensation polymer shell, which shells can be integral and thus form a thin coating on the core, and an overcoating layer comprised of an addition polymer, and wherein the triboelectric charging characteristics of colorants are passivated or substantially passivated.

It is still another feature of the present invention to provide colored encapsulated toners whose sensitivity to moisture is eliminated or substantially reduced.

Another feature of the present invention relates to the provision of colored encapsulated toners whose triboelectric charging polarity can be desirably controlled or adjusted irrespective of the colorants present in the toners.

Another related feature of the present invention is to provide colored encapsulated toners possessing rapid rates of triboelectrification for two component development.

A further feature of the present invention relates to the provision of nonblocking, free flowing colored encapsulated toners.

An additional feature of the present invention is the provision of colored encapsulated toners exhibiting low fusing properties, thus enabling lowering of the fusing temperature.

A further feature of the present invention is to provide a simple process which enables the generation of small sized colored toners with narrow size distribution without the need to resort to conventional pulverization and classification techniques.

Also, an additional feature of the present invention resides in the provision of colored encapsulated toner compositions comprised of a core containing a polymer resin derived from free radical polymerization, and colorants such as colored pigments or dyes with a wide spectrum of colors such as red, blue, green, brown, yellow, magenta, cyan, and mixtures thereof, a thin cellulose shell, an optional thin condensation polymer shell overcoated with a thin polymeric layer obtained by free radical polymerization, and wherein the charging effects of the colorants present in the toners are passivated or substantially passivated.

These and other features of the present invention can be accomplished by the provision of toners, and more specifically encapsulated toners and processes thereof. In one embodiment of the present invention, there are provided encapsulated toners with a core comprised of a polymer resin derived from the free radical polymerization of monomer, or a plurality of monomers, for example up to 3 or 4, an optional preformed polymer resin, and colorants such as color pigment particles; encapsulated within a thin polymeric shell or shells; and overcoated thereover a thin polymer overcoating. In another embodiment there are provided, in accordance with the present invention, colored encapsulated toners comprised of a core comprised of a polymer resin derived from free radical polymerization, an optional preformed polymer resin, and colorants excluding black; a thin cellulose shell obtained by adsorption and precipitation of certain cellulose surfactants; an optional condensation polymer shell obtained by interfacial polycondensation; and thereover an overcoating polymer layer obtained by free radical polymerization.

In embodiments of the present invention, there are provided encapsulated toner compositions comprised of an encapsulated toner composition comprised of a core comprised of polymer resins, color pigments, dyes, or mixtures thereof, encapsulated within a condensation polymer shell, and a polymeric surfactant shell and overcoated thereon a polymeric overcoating; an encapsulated toner composition comprised of a core comprised of polymer resins, and color pigments, dyes, or mixtures thereof, and thereover a condensation polymer shell and a cellulose coating, and overcoated thereon an overcoating layer comprised of an addition polymer; and an encapsulated toner composition comprised of a core comprised of addition polymer resins and optional condensation polymer resins, and colorants, a condensation polymer shell, and wherein the condensation polymer shell and cellulose shell can form one integral toner shell or overcoating, a cellulose shell, and an addition polymer overcoating layer.

In an embodiment of the present invention, the encapsulated toners are comprised of a core comprised of a known polymer resin such as a styrene polymer, an acrylate polymer, a methacrylate polymer, and the like, and a colored pigment encapsulated within a first polymeric shell comprised of polyurea, polyurethane, polyester, polyamide, or mixtures thereof; a second cellulose shell; and an overcoating layer comprised of addition polymers such as a styrene polymer, an acrylate polymer, a methacrylate polymer, and the like. The presence of the overcoating reinforces the shells' integrity and promotes their effectiveness in containing the core components, in particular color pigments, thus enabling passivation of their charging effects on the resultant toners. Effective containment of core resins, in particular the core resins with low glass transition temperatures necessary for lower fusing properties, also serve to inhibit their diffusion to the toner's surface, thus eliminating the problem of toner blocking or agglomeration. The overcoating layer also eliminates or substantially reduces the toner's sensitivity to moisture. In some embodiments where the core resin and the overcoating layer are comprised of the same, or substantially similar polymers, excellent fusing properties and greatly improved image projection efficiency can also be obtained.

The aforementioned toners of the present invention can be prepared by a simple one-pot process which comprises (1) dispersing a mixture of a core monomer or monomers, an oil-soluble free-radical initiator, an optional oil-soluble shell precursor or monomer component, colorant, an optional preformed core resin, such as a styrene polymer, an acrylate polymer, a methacrylate polymer, a polyester, and the like present in an effective amount of, for example, from about 5 to about 50 weight percent of the total core polymers, and an optional diluent, by high shear blending into stabilized microdroplets having a specific droplet size and size distribution in an aqueous medium containing a cellulose surfactant; (2) initiating the optional shell-forming interfacial polycondensation by adding a water-soluble shell precursor or monomer component; (3) thereafter, effecting the core resin-forming free radical polymerization by heating; and (4) adsorbing a mixture of an overcoating monomer and an oil-soluble free radical initiator on the encapsulated particle's surface, and subsequently initiating an overcoating free radical polymerization by heating. The two free radical polymerizations are generally conducted in a temperature range of from about 35° C. to over about 120° C., and preferably from about 45° C. to about 90° C., for a period of from about 1 to about 24 hours, depending primarily on the monomers and free radical initiators used. The core resin obtained via free radical polymerization, together with the optional preformed polymer resin, comprises from about 30 to about 95 percent by weight of the toner, the colorant comprises from about 1 to about 15 percent by weight of the toner, the shells comprise from about 0.01 to about 5 percent by weight of the toner, while the overcoating layer comprises about 0.01 to about 10 percent by weight of toner in embodiments thereof. More specifically, the core can comprise a core resin or resins as illustrated herein in an amount of from about 30 to about 95 percent, and preferably in an amount of from about 70 to about 90 percent. There can be added to the core the preformed polymers as illustrated herein in an amount of from 0 to about 50 weight percent, for example, when about 10 weight percent of the preformed polymer is added to the core the core resin present comprises about 85 percent of the core. Accordingly, the total amount of the preformed polymer and core resin is equal to about 95 percent in this situation.

Examples of known core resins selected include, for example, acrylic, methacrylic, styryl and olefinic polymers. These core resins are generally generated by free radical polymerization after the shell forming interfacial polycondensation. Suitable addition monomers are preferably selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known colorants may be selected for the toner compositions of the present invention provided that they do not interfere with the shell forming and core resin forming polymerization reactions. Typical examples of specific colorants, preferably present in an effective amount of, for example, from about 2 to about 10 weight percent of toner, include Paliogen Violet 5100 and 5890 (BASF), Normandy Magenta RD-2400 (Paul Uhlich), Permanent Violet VT2645 (Paul Uhlich), Heliogen Green L8730 (BASF), Argyl Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD Red (Aldrich), Lithol Rubine Toner (Paul Uhlich), Lithol Scarlet 4440 (BASF), Bon Red C (Dominion Color), Royal Brilliant Red RD-8192 (Paul Uhlich), Oracet Pink RF (Ciba Geigy), Paliogen Red 3340 and 3871K (BASF), Lithol Fast Scarlet L4300 (BASF), Heliogen Blue D6840, D7080, K6902, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlich), Paliogen Yellow 152 and 1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1355 and D1351 (BASF), Hostaperm Pink E (Hoechst), Fanal Pink D4830 (BASF), Cinquasia Magenta (Dupont), Paliogen Black L0084 (BASF), Pigment Black K801 (BASF) and carbon blacks such as REGAL 330® (Cabot), Carbon Black 5250 and 5750 (Columbia Chemicals).

For the condensation polymer shell formation via interfacial polycondensation there can be selected two or more shell precursors or monomers, at least one of which is in the microdroplet phase, and at least one of which is in the aqueous phase. Shell formation results when the two shell monomers or precursors undergo polycondensation at the microdroplet/water interface. Typical known shell materials include, for example, polyurea, polyurethane, polyester, polyamide and other condensation polymers, as illustrated in U.S. Pat. No. 4,877,706, the disclosure of which is totally incorporated herein by reference, and the like. Typical shell monomers or precursors present in the microdroplet phase are polyisocyanates, polyacyl halides, polyhaloformates and the like, and are preferably selected from the group consisting of polyisocyanates, such as benzene diisocyanate, toluene diisocyanate, diphenylmethane diisocyanate, hexamethylene diisocyanate, cyclohexane diisocyanate, bis(4-isocyanatocyclohexyl)methane, polymethylene polyphenylisocyanates, PAPI 27 TM, PAPI 135 TM, PAPI 94 TM, PAPI 901 TM, MONDUR MR TM, MONDUR MRS TM, MONDUR MRS-10 TM, modified diphenylmethane diisocyanates, ISONATE 143L TM, ISONATE 181 TM, ISONATE 191 TM, ISONATE 240 TM, MONDUR PF TM, and MONDUR XP-744 TM, modified toluene diisocyanates, MONDUR CB-60 TM, MONDUR CB-601 TM, MONDUR CB-75 TM, aliphatic polyisocynates, DESMODUR W TM, DESMODUR N-75 TM, DESMODUR N-751 TM, DESMODUR N-100 TM, DESMODUR L-2291A TM, DESMODUR Z-4370 TM, DESMODUR Z-4370/2 TM, polyether Vibrathanes B-604, B-614, B-635, B-843, polyether isocyanate prepolymers E-21 or E-21A, XP-743, XP-744, and the like; polyacyl halides such as adipoyl chloride, fumaryl chloride, suberoyl chloride, succinyl chloride chloride, phthaloyl chloride, isophthaloyl chloride, terephthaloyl chloride; and polyhaloformates such as ethylene glycol bischloroformate, diethylene glycol bischloroformate, and triethylene bischloroformate. Typical shell monomers or precursors that are added to the aqueous phase include polyamines such as ethylenediamine, tetramethylenediamine, pentamethylenediamine, hexamethylenediamine, p-phenylenediamine, m-phenylenediamine, hydroxytrimethylenediamine, methylpentamethylenediamine, diethylenetriamine, triethylenetetraamine, tetraethylenepentaamine, diaminooctane, xylylene diamine, bis(hexamethylene)triamine, tris(2-aminoethyl)amine, 4,4'-methylenebis(cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine; and polyols such as butanediol, hexanediol, bisphenol A, bisphenol Z, and the like. When desired, a water soluble crosslinking agent, such as triamine or triol, can also be added to improve the mechanical strength of the shell polymer. The thickness of the shell can generally be adjusted to be less than 0.5 micron, and preferably to be less than 0.1 micron, provided that the desired mechanical strength of the shell can be maintained.

The overcoating layer of the toner compositions of the present invention can be formed by free radical polymerization of addition monomers adsorbed on the encapsulated particles. The addition monomers which can be selected for the preparation of the overcoating layer include, but are not limited to, methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof. In general, an overcoating thickness of less than 2 microns is desirable, with the preferred thickness being less than 0.2 micron, and more specifically from about 0.1 to about 0.2 micron.

In one specific embodiment of the present invention, there is provided an improved process for the preparation of encapsulated toner compositions, which process comprises mixing and dispersing a mixture of core monomers, oil soluble free-radical initiators, an optional oil-soluble shell precursor or monomer, color pigment particles or dyes, an optional preformed core resin, and an optional diluent into stabilized microdroplets in an aqueous solution of a cellulose surfactant. The average microdroplet diameter can be desirably adjusted to be in the range of from about 1 micron to about 30 microns, and preferably from about 2 to about 9 microns with a droplet size distribution of less than 1.4, and preferably less than 1.35 by controlling the nature and viscosity of the organic phase, the nature and concentration of cellulose surfactant, and the dispersion mechanism; both the microdroplet diameter and size distribution are inferred from Coulter Counter measurements of the resultant encapsulated particles; initiating the optional condensation polymer shell formation by adding a water soluble shell precursor or monomer component; effecting the core resin-forming free radical polymerization by, for example, heating the reaction mixture from room temperature to about 90° C. for a period of from about 1 to about 24 hours; and subsequently adsorbing a mixture of addition monomers and an oil soluble free radical initiator on the resulting encapsulated particles, and subsequently effecting the free radical polymerization on the particle's surface to form the overcoating layer in a temperature range of from about 35° C. to about 100° C. for 1 to about 24 hours, optionally in the presence of a water soluble free radical inhibitor.

Cellulose surfactants selected for the toners and process of the present invention include, but are not limited to, methyl cellulose, ethyl cellulose, propyl cellulose, hydroxyethyl cellulose, hydroxypropyl cellulose, hydroxyethyl methyl cellulose, TYLOSE TM and the like. The effective concentration of the cellulose surfactant in the aqueous reaction medium is, for example, from about 0.1 percent by weight to about 5 percent by weight, with the preferred amount being determined primarily by the nature of the toner precursor materials and the desired toner particle size. In some embodiments, inorganic surfactants are also utilized in combination with the cellulose surfactant for achieving a smaller microdroplet size. Illustrative examples of suitable inorganic surfactants include potassium oleate, potassium caprate, potassium stearate, sodium laurate, sodium dodecyl sulfate, sodium oleate, sodium laurate, and the like. The effective concentration of inorganic surfactant that is generally employed is from about 0.005 to about 0.5 percent by weight, and preferably from about 0.01 to about 0.10 percent by weight. Suitable oil soluble free-radical initiators selected for the preparation of the toners of the present invention include azo-type initiators such as 2,2'-azobis(dimethylvaleronitrile), azobis(isobutyronitrile), azobis(cyclohexanenitrile), azobis(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl-2,5-bis(2-ethylhexanoylperoxy)hexane, di-tert-butyl peroxide, cumene hydroperoxide, dichlorobenzoyl peroxide, and mixtures thereof, with the quantity of initiator being, for example, from about 0.1 percent to about 10 percent by weight of that of core monomer. Water-soluble free radical inhibitors can also be employed to suppress or inhibit emulsion polymerization in the aqueous phase. The emulsion polymerization in the aqueous phase, if uninhibited or unsuppressed, could result in the formation of unwanted emulsion-polymerized polymer particles, which would contaminate the desired overcoated encapsulated particle product. The aforementioned emulsion polymerization could also consume a portion of the addition monomer that is intended for the overcoating free radical polymerization. Illustrative examples of water-soluble free radical inhibitors include copper salts, ammonium thiocyanate, sodium nitrite, and the like. In situations where addition monomers having some solubility in water are utilized for the preparation of the overcoating layer, it may be advantageous to dissolve some metal salts such as potassium chloride, potassium sulfate, sodium chloride, sodium sulfate and the like, in the aqueous phase to suppress the solubility of the monomer in water.

Interfacial polymerization processes selected for the second shell formation of the toners of the present invention are as illustrated, for example, in U.S. Pat. Nos. 4,000,087 and 4,307,169, the disclosures of which are totally incorporated herein by reference.

Other known core resins, colored pigments, condensation polymer shells, polymeric surfactant shells, and overcoatings not specifically mentioned herein may be selected for the toners and processes of the present invention. In an embodiment of the present invention, thin shells are desirable for the reasons as illustrated herein; for example, the thickness of the first condensation polymer shell and the second polymeric surfactant shell is from about 0.001 to about 2 microns and preferably from about 0.1 to about 0.5 micron. The first condensation polymer shell can be of an effective thickness of from about 0 to about 0.50 micron while the second polymeric surfactant shell can be of an effective thickness of, for example, from about 0.0001 to about 0.5 micron. Although not being desired to be limited by theory, it is believed that the condensation polymer first shell and the polymeric surfactant second shell can be integral with each other, however, as illustrated herein, separate first and second shells may also be present.

Surface additives can be selected for the toners of the present invention including, for example, metal salts, metal salts of fatty acids, colloidal silicas, powdered metal oxides, mixtures thereof, and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred additives include zinc stearate, Aerosil and powdered metal oxides.

Charge control additives can also be employed either in the bulk or on the surface of toners to control their triboelectric charging characteristics. Illustrative examples of known charge control additives include metal oxides, metal salts, metal salts of fatty acids, colloidal silicas, quarternary ammonium salts, sulfonamides, sulfonimides, metal complexes, organometallic complexes, mixtures thereof, and the like.

For two component developers, known carrier particles including steel ferrites, copper zinc ferrites, and the like, with or without coatings, can be admixed, for example, from about 1 to about 5 parts of toner per about 100 parts of carrier with the encapsulated toners of the present invention, reference for example the carriers illustrated in U.S. Pat. Nos. 4,937,166; 4,935,326; 4,883,736; 4,560,635; 4,298,672; 3,839,029; 3,847,604; 3,849,182; 3,914,181; 3,929,657 and 4,042,518, the disclosures of which are totally incorporated herein by reference.

The encapsulated toners of the present invention and developers thereof can be utilized in various imaging systems as mentioned herein including, more specifically, those wherein latent images are developed on an imaging member and subsequently transferred to a supporting substrate and affixed thereto by cold pressure rollers heat and/or a combination of heat and pressure.

The following examples are being submitted to further define various species of the present invention. These examples are intended to be illustrative only and are not intended to limit the scope of the present invention.

EXAMPLE I

A 7.1 micron (volume average particle diameter) cyan encapsulated toner with a polystyrene overcoating was prepared as follows.

A mixture of 146 grams of isobutyl methacrylate, 37 grams of lauryl methacrylate, and 4.0 grams of Heliogen Blue pigment was ball milled for 24 hours. To this mixture were added 3.0 grams each of 2,2'-azobis-(2,4-dimethylvaleronitrile) and 2,2'-azobis-(isobutyronitrile), and 3.2 grams of DESMODUR W TM, and the mixture was roll blended until all the aforementioned free radical initiators were dissolved. One hundred and fifty (150) grams of the resulting mixture were transferred to a 2-liter reaction vessel containing 700 milliliters of a 1.0 percent aqueous TYLOSE ® solution, and the resulting mixture was homogenized for 2 minutes using a Brinkmann polytron operating at 10,000 rpm. Thereafter, 1.5 grams of 2-methylpentamethylenediamine was added, and the mixture was mechanically stirred at room temperature for 30 minutes. The resulting mixture was subsequently heated to 80° C. over a period of 1 hour, and retained at this temperature for another 10 hours before cooling it down to room temperature. A solution of 0.30 gram of benzoyl peroxide in 14.0 grams of styrene, and 0.03 gram of sodium nitrite were then added to the mixture, and the resulting mixture was sonicated for 5 minutes using a Branson 184 V sonicator, operating at a frequency of 20 MHz, with an output power of 700 watts at 60 percent amplitude. Subsequent to sonication, the reaction mixture was stirred mechanically at room temperature for 1 hour, and then at 80° C. for another 5 hours. After the aforementioned reaction, the particle product was washed repeatedly with water until the aqueous phase was clear, and the product resulting was then freeze dried by well known methods. The encapsulated toner evidenced a volume average particle diameter of 7.1 microns, and a particle size distribution of 1.33 according to Coulter Counter measurements.

Fifty (50.0) grams of the resultant encapsulated toner product was dry blended with a mixture of 0.20 gram of AEROSIL R812 ® and 0.30 gram of conductive tin oxide powder for 10 minutes using a Grey blender with its blending impeller operating at 2,500 rpm. The toner exhibited excellent powder flow characteristics, and was stable at 55° C. for 48 hours.

A negatively charged developer was prepared by blending 98 parts by weight of the encapsulated particles obtained with 2 parts by weight of Xerox Corporation 9200 TM carrier particles comprised of a ferrite core coated with a terpolymer of methylmethacrylate, styrene, and vinyl triethoxy polymer, 0.7 percent weight coating, reference U.S. Pat. Nos. 3,467,634 and 3,526,533, the disclosures of which are totally incorporated herein by reference. The toner displayed a triboelectric value of −19.4 microcoulombs per gram as determined in the known Faraday Cage apparatus. Also, it is believed that excellent images can be generated with the aforementioned developer, which images would possess acceptable resolution characteristics and wherein the latent images are initially formed in a xerographic experimental imaging device similar to the Xerox Corporation 9200 TM, and subsequent to the development of images with the aforementioned prepared encapsulated toner the images were transferred to a paper substrate and fixed with heat, about 160° C., with a Viton fuser roll.

EXAMPLE II

A 7.8 micron magenta encapsulated toner with a polystyrene overcoating was prepared as follows.

A mixture of 85.0 grams each of n-butyl methacrylate and isobutyl methacrylate, and 5.5 grams of Fanal Pink pigment was ball milled for 24 hours. To this mixture were added 4.5 grams of 2,2'-azobis(isobutyronitrile), and 3.0 grams of ISONATE 143L TM, and the mixture was roll blended until all the aforementioned azobis free radical initiator was dissolved. One hundred and fifty (150) grams of the resulting mixture were transferred to a 2-liter reaction vessel containing 700 milliliters of 1.0 percent aqueous TYLOSE ® (a hydroxyethylmethyl cellulose) solution, and was homogenized for 2 minutes using a Brinkmann polytron operating at 10,000 rpm. Thereafter, 1.5 grams of 2-methylpentamethylenediamine was added, and the resulting mixture was mechanically stirred at room temperature for 30 minutes. The aforementioned mixture was subsequently heated to 80° C. over a period of 1 hour, and retained at this temperature for another 10 hours. A solution of 0.15 gram of benzoyl peroxide in 7.5 grams of styrene, and 0.03 gram of sodium nitrite were added, and the resulting mixture was sonicated for 5 minutes using a Branson 184 V sonicator operating at a frequency of 20 MHz with an output power of 700 watts at 60 percent amplitude. After sonication, the reaction mixture was stirred mechanically at room temperature for 1 hour, and then at 80° C. for another 5 hours. The reaction mixture was cooled down to room temperature, and the particle product was washed repeatedly with water until the aqueous phase was clear, and the clear aqueous phase was then freeze dried. The encapsulated toner product evidenced a volume average particle diameter of 7.8 microns, and a particle size distribution of 1.29 according to Coulter Counter measurement.

Fifty (50.0) grams of the prepared overcoated encapsulated toner particles were dry blended with a mixture of 0.20 gram of AEROSIL R812 TM and 0.30 gram of conductive tin oxide powder for 10 minutes using a Greey blender with its blending impeller operating at 2,500 rpm. The toner exhibited excellent powder flow characteristics, and was stable at 55° C. for 72 hours. A negatively charged developer was prepared by blending 98 parts by weight of the encapsulated particles obtained with 2 parts by weight of Xerox Corporation 9200 TM carrier particles, reference Example I. The toner had a triboelectric value of −20.1 microcoulombs per gram as determined in a Faraday Cage apparatus. When the aforementioned developer is incorporated into the xerographic imaging test fixture of Example I, it is believed that substantially similar results can be obtained.

EXAMPLE III

A 8.1 micron yellow encapsulated toner with a polystyrene overcoating was prepared by the following procedure.

A mixture of 140.0 grams of isobutyl methacrylate, 30.0 grams of poly(n-butyl methacrylate), 8.0 grams of Sicofast Yellow pigment, and 20 milliliters of methylene chloride was ball milled for 24 hours. To this mixture were added 4.5 grams of 2,2'-azobis-(isobutyronitrile), and 3.0 grams of ISONATE 143L TM, and the mixture was roll blended until all of the azobis free radical initiator was dissolved. One hundred and seventy (170) grams of the resulting mixture were transferred to a 2-liter reaction vessel containing 700 milliliters of 1.0 percent aqueous TYLOSE ® solution, and was homogenized for 2 minutes using a Brinkmann polytron operating at 10,000 rpm. Thereafter, 1.5 grams of 2-methylpentamethylenediamine was added, and the mixture was mechanically stirred at room temperature for 30 minutes. The mixture was subsequently heated to 80° C. over a period of 1 hour, and retained at this temperature for another 10 hours. A solution of 0.20 gram of 2,2'-azobis-(isobutyronitrile) in 10.0 grams of styrene and 0.03 gram of sodium nitrite was added, and the resulting mixture was sonicated for 5 minutes using a Branson 184 V sonicator operating at a frequency of 20 MHz with an output power of 700 watts at 60 percent amplitude. After sonication, the reaction mixture was stirred mechanically at room temperature for 1 hour, and then at 80° C. for another 5 hours. The resulting reaction mixture was cooled down to room temperature, about 25° C., and the toner product was washed repeatedly with water until the aqueous phase was clear. The clear aqueous phase was then freeze dried. The encapsulated toner product evidenced a volume average particle diameter of 8.1 microns, and a particle size distribution of 1.26 according to Coulter Counter measurements.

The above overcoated toner particles were dry blended with 0.20 gram of AEROSIL R812 TM and 0.30 gram of conductive tin oxide powder, and a negatively charged developer was prepared by repeating the procedure of Example I. The toner displayed a triboelectric value of −18.8 microcoulombs per gram.

EXAMPLE IV

A 6.8 micron red encapsulated toner with a poly(methyl methacrylate) overcoating was prepared as follows.

The toner was prepared in accordance with the procedure of Example I except that a mixture of 150.0 grams of isobutyl methacrylate, 20.0 grams of styrene, and 7.5 grams of Lithol Scarlet pigment was utilized in place of a mixture of 146 grams of isobutyl methacrylate, 37 grams of lauryl methacrylate, and 5.0 grams of Heliogen Blue pigment. In addition, 15.0 grams of methyl methacrylate instead of styrene was utilized in the overcoating polymerization reaction. The encapsulated toner product evidenced a volume average particle diameter of 6.8 microns, and a particle size distribution of 1.36. Fifty (50.0) grams of the overcoated toner were dry blended with a mixture of 0.20 gram of AEROSIL R812 TM for 10 minutes using a Grey blender with its blending impeller operating at 2,500 rpm. The toner exhibited excellent powder flow characteristics, and was stable at 55° C. for 72 hours. A positively charged developer was prepared by blending 98 parts by weight of the encapsulated particles obtained in this experiment with 2 parts by weight of Xerox Corporation 9700 TM MICR carrier particles. The toner had a triboelectric value of +15.3 microcoulombs per gram.

EXAMPLE V

An 8.0 micron blue encapsulated toner with a polystyrene overcoating was prepared as follows.

The toner was prepared in accordance with the procedure of Example II except that 4.0 grams of PV Fast Blue pigment were utilized instead of Fanal Pink pigment. In addition, 15.0 grams of styrene and 0.3 gram of benzoyl peroxide were employed for the overcoating polymerization. The encapsulated toner product evidenced a volume average particle diameter of 8.0 microns with a particle size distribution of 1.28. The overcoated toner particles were dry blended in accordance with the procedure of Example IV, and a positively charged developer was prepared by blending 98 parts by weight of the encapsulated particles obtained with 2 parts by weight of Xerox Corporation 9700 TM MICR carrier particles. The toner had a triboelectric value of +14.1 microcoulombs per gram.

EXAMPLE VI

A 7.5 micron magenta encapsulated toner with a poly(methyl methacrylate) overcoating was prepared as follows.

The toner was prepared in accordance with the procedure of Example II except that 15.0 grams of methyl methacrylate in place of styrene were employed for the overcoating polymerization. The overcoated encapsulated toner evidenced a volume average particle diameter of 7.5 microns with a particle size distribution of 1.35. The overcoated toner particles were dry blended in accordance with the procedure of Example IV, and a positively charged developer was prepared by blending 98 parts by weight of the encapsulated particles obtained with 2 parts by weight of Xerox Corporation 9700 TM MICR carrier particles. The toner had a triboelectric value of +14.7 microcoulombs per gram.

When the developers of Examples III, IV, V and VI are incorporated into the xerographic imaging test fixture of Example I, it is believed that substantially similar results can be obtained.

Other modifications of the present invention may occur to those skilled in the art based upon a review of the present application and these modifications, including equivalents thereof, are intended to be included within the scope of the present invention.

What is claimed is:

1. An encapsulated toner composition consisting essentially of a core comprised of polymer resins, color pigments, dyes, or mixtures thereof, encapsulated within a condensation polymer shell, and a polymeric surfactant shell and overcoated thereon a polymeric overcoating.

2. An encapsulated toner composition consisting essentially of a core consisting essentially of polymer resin particles, color pigment particles, dyes, or mixtures thereof, and thereover a condensation polymer shell and a cellulose coating, and overcoated thereon an overcoating layer comprised of an addition polymer.

3. An encapsulated toner composition consisting essentially of a core consisting essentially of an addition polymer resin and a condensation polymer resin, and a colorant or colorants, a condensation polymer shell, a cellulose shell, and an addition polymer overcoating layer.

4. An encapsulated toner in accordance with claim 1 wherein the polymeric surfactant shell is comprised of cellulose materials.

5. An encapsulated toner in accordance with claim 1 wherein the overcoating material is an addition polymer.

6. An encapsulated toner in accordance with claim 1 wherein the core polymer resin is an addition polymer.

7. An encapsulated toner in accordance with claim 3 wherein the condensation polymer shell is selected from the group consisting of polyurea, polyester, polyurethane, polyamide, and mixtures thereof.

8. An encapsulated toner in accordance with claim 3 wherein the overcoating material is selected from the group consisting of styrene, acrylate, and methacrylate polymers.

9. An encapsulated toner in accordance with claim 3 wherein the core polymer is selected from the group consisting of styrene, acrylate, and methacrylate polymers.

10. An encapsulated toner in accordance with claim 1 wherein the core polymer is derived from polymerization of monomer or monomers selected preferably from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, methylstyrene, hexylstyrene, dodecylstyrene, and nonyl styrene.

11. An encapsulated toner in accordance with claim 1 wherein cyan, yellow, magenta, red, green, blue, brown dyes, pigments, or mixtures thereof are selected.

12. An encapsulated toner in accordance with claim 1 wherein the pigment is Paliogen Violet 5100 and 5890, Normandy Magenta RD-2400, Permanent Violet VT2645, Heliogen Green L8730, Argyle Green XP-111-S, Brilliant Green Toner GR 0991, Lithol Scarlet D3700, Toluidine Red, Scarlet for Thermoplast NSD Red, Lithol Rubine Toner, Lithol Scarlet 4440, Bon Red C, Royal Brilliant Red RD-8192, Oracet Pink RF, Paliogen Red 3340 and 3871K, Lithol Fast Scarlet L4300, Heliogen Blue D6840, D7080, K6902, K6910 and L7020, Sudan Blue OS, Neopen Blue FF4012, PV Fast Blue B2G01, Paliogen Blue 6470, Sudan II, III and IV, Sudan Orange, Sudan Orange 220, Paliogen Orange 3040, Ortho Orange OR 2673, Paliogen Yellow 152 and 1560, Lithol Fast Yellow 0991K, Paliotol Yellow 1840, Novoperm Yellow FGL, Permanent Yellow YE 0305, Lumogen Yellow D0790, Suco-Gelb L1250, Suco-Yellow D1355, Sico Fast Yellow D1355 and D1351, Hostaperm Pink E, Fanal Pink D4830, Cinquasia Magenta, Paliogen Black L0084, Pigment Black K801 carbon black, or mixtures thereof.

13. An encapsulated toner in accordance with claim 2 wherein cyan, yellow, magneta, red, green, blue, brown dyes, or pigments are selected.

14. A toner in accordance with claim 3 wherein the core resins comprise from about 30 to about 95 percent by weight of the toner, the colorant or colorants comprise from about 1 to about 15 percent by weight of the toner, the condensation polymer shell and cellulose shell comprise from about 0.01 to about 5 percent by weight of the toner, and the polymer overcoating layer comprises from about 0.01 to about 10 percent by weight of the toner.

15. A toner in accordance with claim 3 containing surface additives.

16. A toner in accordance with claim 15 wherein the surface additives are comprised of conductive metal oxides, metal salts, metal salts of fatty acids, colloidal silicas, quaternary ammonium salts, sulfonamides, sulfonimides, metal complexes, organometallic complexes, or mixtures thereof.

17. A toner in accordance with claim 16 wherein conductive tin oxide powder and zinc stearate are selected.

18. A toner in accordance with claim 16 wherein conductive tin oxide powder and Aerosils are selected.

19. A toner in accordance with claim 15 wherein the additives are present in an amount of from about 0.1 to about 10 weight percent of the toner.

20. A toner in accordance with claim 3 wherein the condensation polymer shell is obtained by interfacial polymerization, and the core resin and the overcoating polymer are obtained by free radical polymerization.

21. A toner in accordance with claim 2 wherein the condensation polymer shell is obtained by interfacial polymerization, and the core resin and the overcoating polymer are obtained by free radical polymerization.

22. A toner in accordance with claim 1 wherein the condensation polymer shell is obtained by interfacial polymerization, and the core resin and the overcoating polymer are obtained by free radical polymerization.

23. A toner in accordance with claim 2 wherein the toner contains charge control additives.

24. A toner in accordance with claim 23 wherein the charge control additives are comprised of quarternary ammonium salts, colloidal silicas, metal oxides, sulfonamides, sulfonimides, metal complexes, or organometallic complexes.

25. A toner in accordance with claim 24 wherein the charge control additives are comprised of tin oxide powder and Aerosils.

26. A process for the preparation of encapsulated toner compositions consisting essentially of forming a stable organic microdroplet suspension in an aqueous medium comprising a cellulose surfactant, forming a condensation polymer shell around the microdroplets by interfacial polycondensation, forming a cellulose coating by adsorption and precipitation of said cellulose surfactant, thereafter forming core resins within the encapsulated particles by free radical polymerization of core monomers present within the particles, and subsequently effecting an overcoating by free radical polymerization of monomers whereby said monomers form a polymer adsorbed on the toner surface.

27. A process in accordance with claim 26 wherein the free radical polymerizations are accomplished at a temperature of from about 35° C. to about 120° C.

28. A process in accordance with claim 26 wherein the organic microdroplets contain at least one core monomer, at least one shell precursor or monomer component, at least one free radical initiator, color pigments or dyes, and an optional preformed core resin.

29. An imaging process which comprises the generation of an image on an imaging surface, subsequently developing this image with the toner composition of claim 1, thereafter transferring the image to a suitable substrate, and permanently affixing the image thereto.

30. An imaging process which comprises the generation of an image on an imaging surface, subsequently developing this image with the toner composition of claim 2, thereafter transferring the image to a suitable substrate, and permanently affixing the image thereto.

31. An imaging process which comprises the generation of an image on an imaging surface, subsequently developing this image with the toner composition of claim 3, thereafter transferring the image to a suitable substrate, and permanently affixing the image thereto.

32. An imaging method in accordance with claim 31 wherein fixing is accomplished by heat.

33. An imaging method in accordance with claim 31 wherein fixing is accomplished by a combination of pressure and heat.

34. An encapsulated toner in accordance with claim 1 wherein the overcoating material is selected from the group consisting of styrene, acrylate, and methacrylate polymers.

35. An encapsulated toner in accordance with claim 2 wherein the overcoating material is selected from the group consisting of styrene, acrylate, and methacrylate polymers.

36. A toner composition in accordance with claim 1 wherein the thickness of the condensation polymer shell and the polymeric surfactant shell is from about 0.001 to about 2 microns.

37. A toner composition in accordance with claim 1 wherein the thickness of the condensation polymer shell and the polymeric surfactant shell is from about 0.01 to about 0.5 micron.

38. A toner composition in accordance with claim 1 wherein the condensation polymer shell is of a thickness of from about 0.1 to about 0.50 micron.

39. A toner composition in accordance with claim 1 wherein the surfactant shell is of a thickness of from about 0.0001 to about 5 microns.

40. A toner composition in accordance with claim 1 wherein the overcoating is of a thickness of from about 0.1 to about 2 microns.

41. A toner composition in accordance with claim 2 wherein the overcoating is of a thickness of from about 0.1 to about 2 microns.

42. A toner composition in accordance with claim 3 wherein the overcoating is of a thickness of from about 0.1 to about 2 microns.

43. An encapsulated toner in accordance with claim 2 wherein the cellulose is selected from the group consisting of methyl cellulose, ethyl cellulose, propyl cellulose, hydroxyethyl cellulose, hydroxypropyl cellulose, and hydroxyethyl methyl cellulose.

44. An encapsulated toner in accordance with claim 3 wherein the cellulose is selected from the group consisting of methyl cellulose, ethyl cellulose, propyl cellulose, hydroxyethyl cellulose, hydroxypropyl cellulose, and hydroxyethyl methyl cellulose.

45. An encapsulated toner in accordance with claim 4 wherein the cellulose is selected from the group consisting of methyl cellulose, ethyl cellulose, propyl cellulose, hydroxyethyl cellulose, hydroxypropyl cellulose, and hydroxyethyl methyl cellulose.

* * * * *